US010161671B2

(12) United States Patent
Chellappan

(10) Patent No.: US 10,161,671 B2
(45) Date of Patent: Dec. 25, 2018

(54) ADJUSTABLE SHELF FOR A REFRIGERATOR APPLIANCE

(71) Applicant: Haier US Appliance Solutions, Inc., Wilmington, DE (US)

(72) Inventor: Bagawathkumar Chellappan, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 0 days.

(21) Appl. No.: 15/493,386

(22) Filed: Apr. 21, 2017

(65) Prior Publication Data

US 2018/0306490 A1 Oct. 25, 2018

(51) Int. Cl.

| | |
|---|---|
| ***F25D 25/02*** | (2006.01) |
| ***F25D 11/02*** | (2006.01) |
| ***F25D 23/06*** | (2006.01) |
| ***A47B 57/06*** | (2006.01) |

(52) U.S. Cl.

CPC ..... *F25D 25/02* (2013.01); *A47B 57/06* (2013.01); *F25D 11/02* (2013.01); *F25D 23/067* (2013.01); *F25D 2325/021* (2013.01)

(58) Field of Classification Search

CPC ..... A47B 57/06; F25D 11/02; F25D 25/02; F25D 23/067

USPC ..... 312/401, 408, 410, 306, 312, 319.5, 312/319.7, 351; 108/106, 107, 108, 147, 108/147.11, 147.17; 62/440, 382

See application file for complete search history.

(56) References Cited

U.S. PATENT DOCUMENTS

| | | | | |
|---|---|---|---|---|
| 3,982,801 | A | 9/1976 | Heidorn et al. | |
| 5,913,584 | A * | 6/1999 | Swindell | A47B 57/06 108/108 |
| 6,065,821 | A * | 5/2000 | Anderson | A47B 57/06 108/108 |
| 7,178,890 | B2 * | 2/2007 | Park | A47B 57/06 312/408 |
| 8,485,618 | B2 * | 7/2013 | Benz | A47B 57/06 312/312 |
| 8,529,001 | B2 | 9/2013 | Calvillo et al. | |
| 8,556,093 | B2 * | 10/2013 | Davis | A47B 57/00 211/175 |
| 2008/0246382 | A1 * | 10/2008 | Kang | A47B 57/06 312/408 |

* cited by examiner

*Primary Examiner* — James O Hansen

(74) *Attorney, Agent, or Firm* — Dority & Manning P.A.

(57) ABSTRACT

An adjustable shelf assembly for a refrigerator appliance includes a rear bracket and a rack positioned on the rear bracket. A pinion gear is meshed with the rack. A shelf frame is slidably mounted to the rear bracket. The pinion gear is rotatably mounted to the shelf frame. An actuator is positioned on the shelf frame. A line couples the actuator to the pinion gear such that the pinion gear is rotatable with the actuator via the line. The shelf frame is configured to move along a vertical direction relative to the rear bracket when the pinion gear is rotated by the actuator via the line. A related refrigerator appliance is also provided.

18 Claims, 5 Drawing Sheets

ADJUSTABLE SHELF FOR A REFRIGERATOR APPLIANCE

FIELD OF THE INVENTION

The present subject matter relates generally to adjustable shelves for refrigerator appliances.

BACKGROUND OF THE INVENTION

Refrigerator appliances have a chilled chamber for receipt of food articles for storage. Refrigerator appliances can also include various storage components mounted within the chilled chamber to facilitate storage of food items with the chilled chamber. Such storage components can include racks, bins, shelves, or drawers that receive food items and assist with organizing and arranging of such food items within the chilled chamber.

Certain refrigerator appliances include one or more shelves for holding or supporting food items within the chilled chamber. The height of the shelf may be changed according to the needs of a user. For instance, a shelf may be removably supported on a bracket that is permanently fixed to the refrigerator. Multiple predetermined mounting heights may be defined on the bracket by slots that receive the shelf. In order to change the height of the shelf, the shelf must be removed from the bracket. Generally, this requires a user to pivot and/or lift the shelf relative to the bracket. Moreover, the shelf must be at least partially removed from the chilled chamber.

Adjusting the height of such existing systems can be undesirably complicated. For instance, any food items held or supported by the shelf must generally be removed before the shelf may be adjusted. If the food items are not first removed, a user risks spilling or dropping the items while the shelf is unsupported by the bracket. Even if all the food items are removed, properly aligning the shelf to the bracket may be difficult for some users. Furthermore, the shelf will have only a limited number of predetermined heights, as determined by the bracket. This, in turn, limits a user's options for configuring the shelf height, as well as the overall useable space within the chilled chamber.

Accordingly, an appliance with features for easily and reliably adjusting a shelf height within the appliance would be useful. In particular, a refrigerator appliance with features for easily varying the height of a shelf while mounted within a refrigerator appliance would be useful.

BRIEF DESCRIPTION OF THE INVENTION

The present subject matter provides an adjustable shelf assembly for a refrigerator appliance. The adjustable shelf assembly includes a rear bracket and a rack positioned on the rear bracket. A pinion gear is meshed with the rack. A shelf frame is slidably mounted to the rear bracket. The pinion gear is rotatably mounted to the shelf frame. An actuator is positioned on the shelf frame. A line couples the actuator to the pinion gear such that the pinion gear is rotatable with the actuator via the line. The shelf frame is configured to move along a vertical direction relative to the rear bracket when the pinion gear is rotated by the actuator via the line. A related refrigerator appliance is also provided. Additional aspects and advantages of the invention will be set forth in part in the following description, or may be apparent from the description, or may be learned through practice of the invention.

In a first exemplary embodiment, a refrigerator appliance is provided. The refrigerator appliance includes a cabinet that defines a chilled chamber. An adjustable shelf assembly is positioned within the chilled chamber of the cabinet. The adjustable shelf assembly includes a rear bracket mountable to the cabinet. A rack is positioned on the rear bracket. A pinion gear is meshed with the rack. A shelf frame is slidably mounted to the rear bracket. The pinion gear is rotatably mounted to the shelf frame. An actuator is positioned on the shelf frame. A line couples the actuator to the pinion gear such that the pinion gear is rotatable with the actuator via the line. The shelf frame is configured to move along a vertical direction relative to the rear bracket when the pinion gear is rotated by the actuator via the line.

In a second exemplary embodiment, an adjustable shelf assembly for a refrigerator appliance is provided. The adjustable shelf assembly includes a rear bracket and a rack positioned on the rear bracket. A pinion gear is meshed with the rack. A shelf frame is slidably mounted to the rear bracket. The pinion gear is rotatably mounted to the shelf frame. An actuator is positioned on the shelf frame. A line couples the actuator to the pinion gear such that the pinion gear is rotatable with the actuator via the line. The shelf frame is configured to move along a vertical direction relative to the rear bracket when the pinion gear is rotated by the actuator via the line.

In a third exemplary embodiment, an adjustable shelf assembly for a refrigerator appliance is provided. The adjustable shelf assembly includes a rear bracket and a shelf frame slidably mounted to the rear bracket. An actuator is positioned on the shelf frame. The adjustable shelf assembly also includes means for moving the shelf frame along a vertical direction relative to the rear bracket with the actuator.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
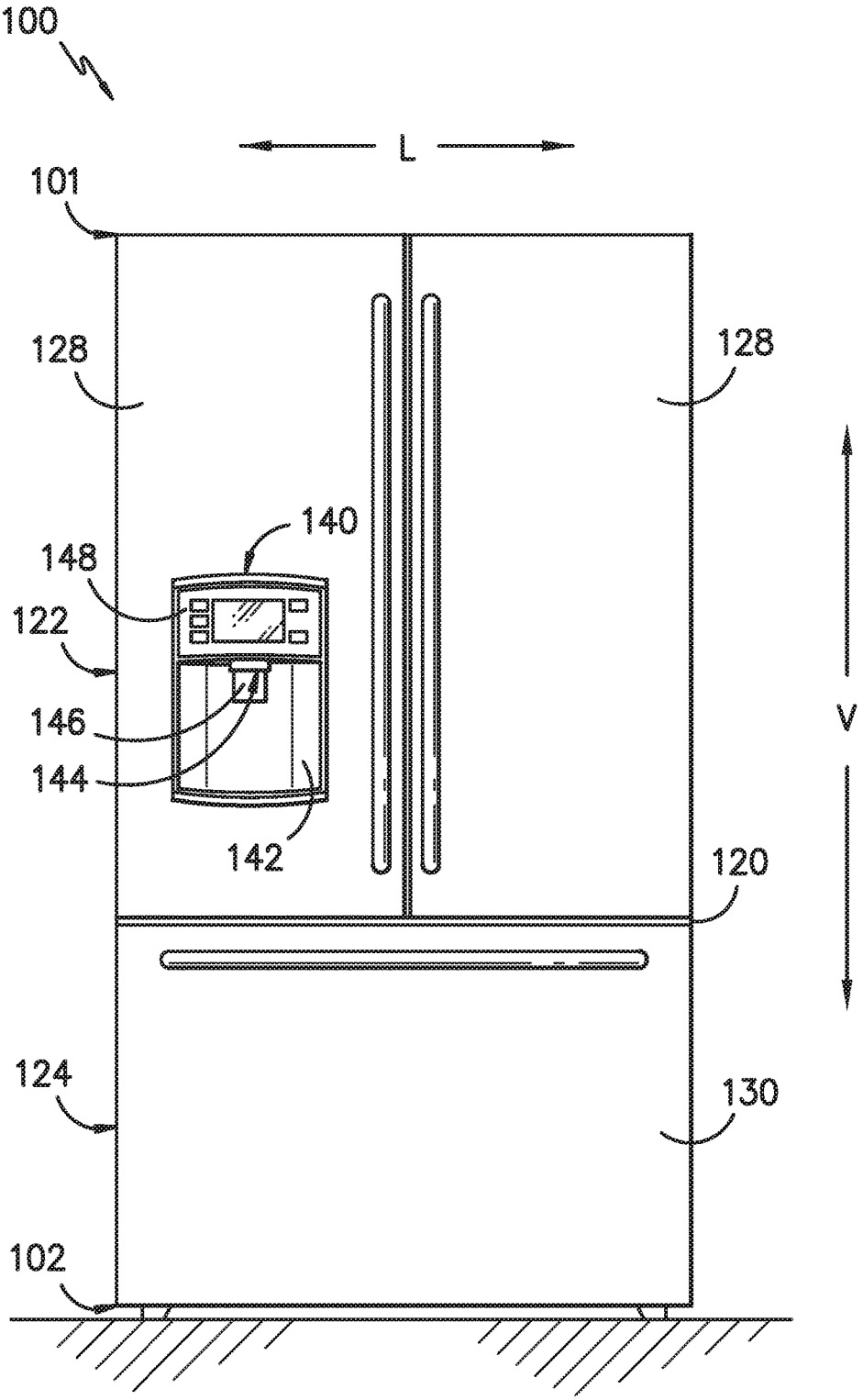
FIG. 1 provides a front, elevation view of a refrigerator appliance according to an exemplary embodiment of the present subject matter.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

Figure 2:
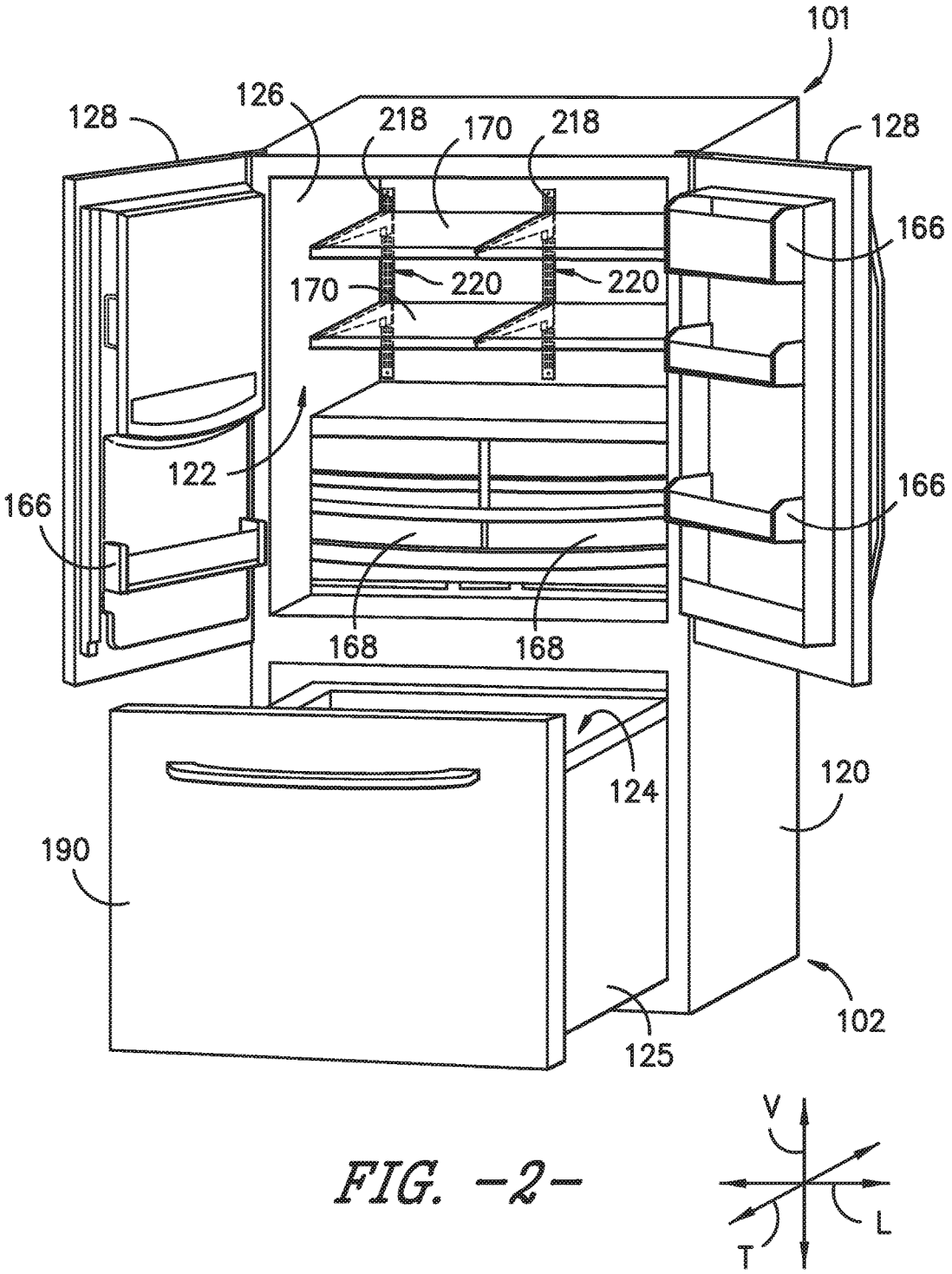
FIG. 2 provides a perspective view of the exemplary refrigerator appliance of FIG. 1 with doors of the exemplary refrigerator appliance shown in an open position.

FIG. 1 provides a front, elevation view of a refrigerator appliance 100 according to an example embodiment of the present disclosure. FIG. 2 provides a front, elevation view of refrigerator appliance 100 having multiple doors 128 shown in an open position. As shown, refrigerator appliance 100 includes a housing or cabinet 120 that extends between a top portion 101 and a bottom portion 102 along a vertical direction V. Cabinet 120 also extends along a lateral direction L and a transverse direction T. The vertical direction V, lateral direction L, and transverse direction T are mutually perpendicular to one another and form an orthogonal direction system.

Cabinet 120 includes a liner 121 that defines chilled chambers for receipt of food items for storage. In particular, liner 121 defines a fresh food chamber 122 positioned at or adjacent top 101 of cabinet 120 and a freezer chamber 124 arranged at or adjacent bottom 102 of cabinet 120. As such, refrigerator appliance 100 is generally referred to as a bottom mount refrigerator. It is recognized, however, that the benefits of the present disclosure apply to other types and styles of appliances such as, e.g., a top mount refrigerator appliance, a side-by-side style refrigerator appliance, or a range appliance. Consequently, the description set forth herein is for illustrative purposes only and is not intended to be limiting in any aspect to any particular refrigerator chamber configuration.

Refrigerator doors 128 are rotatably hinged to an edge of cabinet 120 for selectively accessing fresh food chamber 122. In addition, a freezer door 130 is arranged below refrigerator doors 128 for selectively accessing freezer chamber 124. Freezer door 130 is coupled to a freezer drawer 125 slidably mounted within freezer chamber 124. Refrigerator doors 128 and freezer door 130 are shown in the closed position in FIG. 1 and in the open position in FIG. 2.

In some embodiments, refrigerator appliance 100 also includes a dispensing assembly 140 for dispensing liquid water and/or ice. Dispensing assembly 140 includes a dispenser 142 positioned on or mounted to an exterior portion of refrigerator appliance 100, e.g., on one of refrigerator doors 128. Dispenser 142 includes a discharging outlet 144 for accessing ice and liquid water. An actuating mechanism 146, shown as a paddle, is mounted below discharging outlet 144 for operating dispenser 142. In alternative exemplary embodiments, any suitable actuating mechanism may be used to operate dispenser 142. For example, dispenser 142 can include a sensor (such as an ultrasonic sensor) or a button rather than the paddle. A control panel 148 is provided for controlling the mode of operation. For example, control panel 148 includes a plurality of user inputs (not labeled), such as a water dispensing button and an ice-dispensing button, for selecting a desired mode of operation such as crushed or non-crushed ice.

Discharging outlet 144 and actuating mechanism 146 are an external part of dispenser 142 and are mounted in a dispenser recess 150. Dispenser recess 150 is positioned at a predetermined elevation convenient for a user to access ice or water and enabling the user to access ice without the need to bend-over and without the need to open refrigerator doors 128.

According to the illustrated embodiment, various storage components are mounted within fresh food chamber 122 to facilitate storage of food items therein as will be understood by those skilled in the art. In particular, the storage components include storage bins 166, drawers 168, and shelves 170 that are mounted within fresh food chamber 122. Storage bins 166, drawers 168, and shelves 170 are configured for receipt of food items (e.g., beverages and/or solid food items) and may assist with organizing such food items. As an example, drawers 168 can receive fresh food items (e.g., vegetables, fruits, and/or cheeses) and increase the useful life of such fresh food items.

Figure 3:
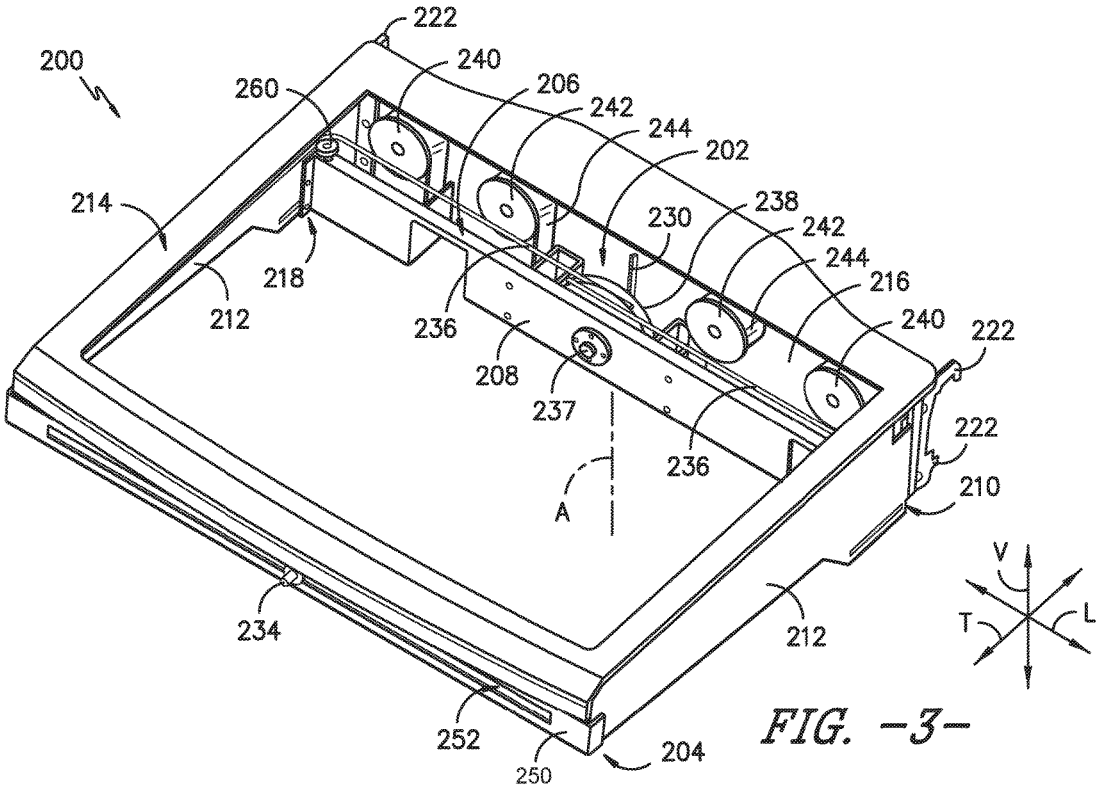
FIG. 3 provides a perspective view of an adjustable shelf assembly according to an exemplary embodiment of the present subject matter.
Figure 4:
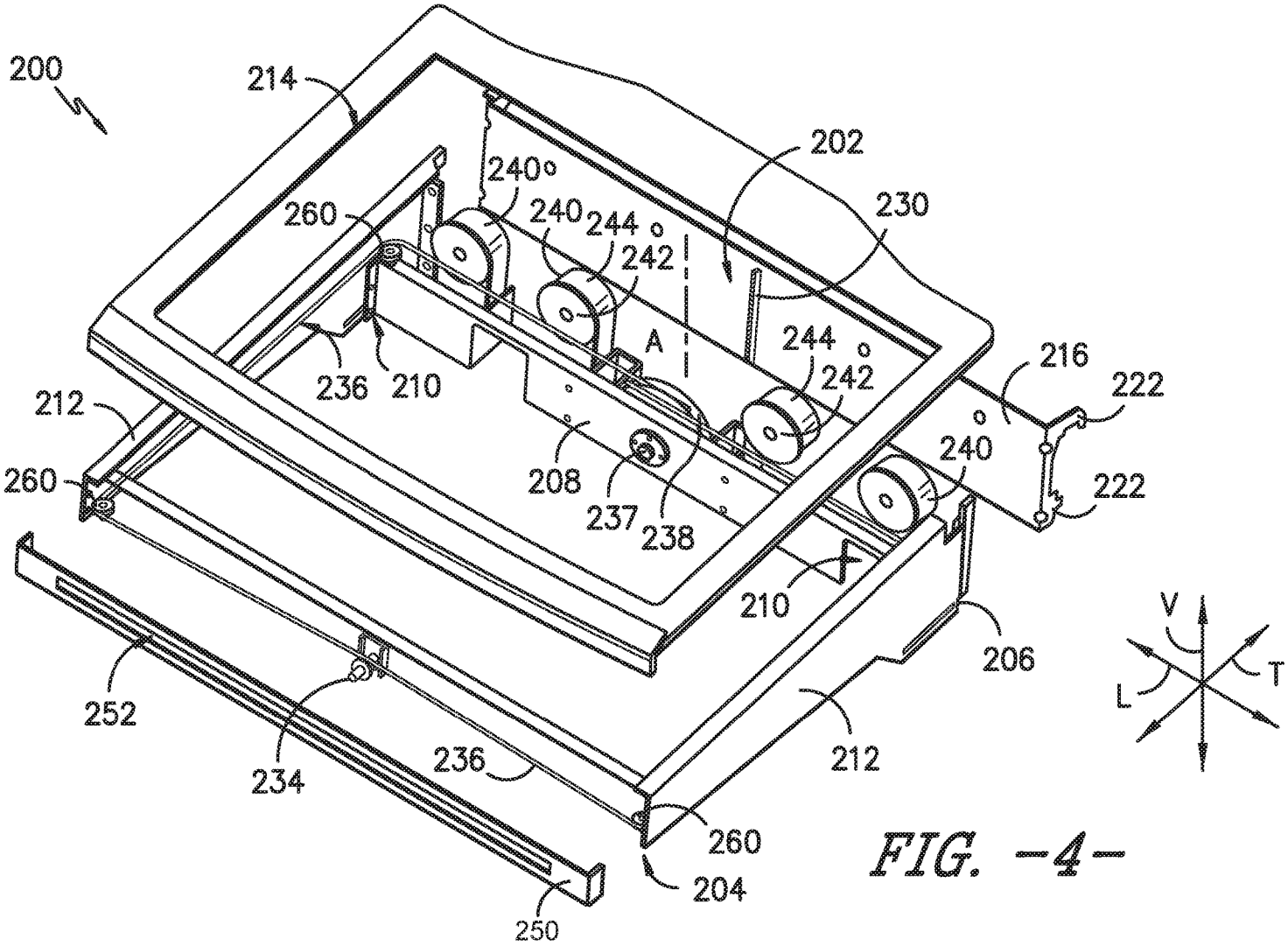
FIG. 4 provides an exploded view of the exemplary adjustable shelf assembly of FIG. 3.
Figure 5:
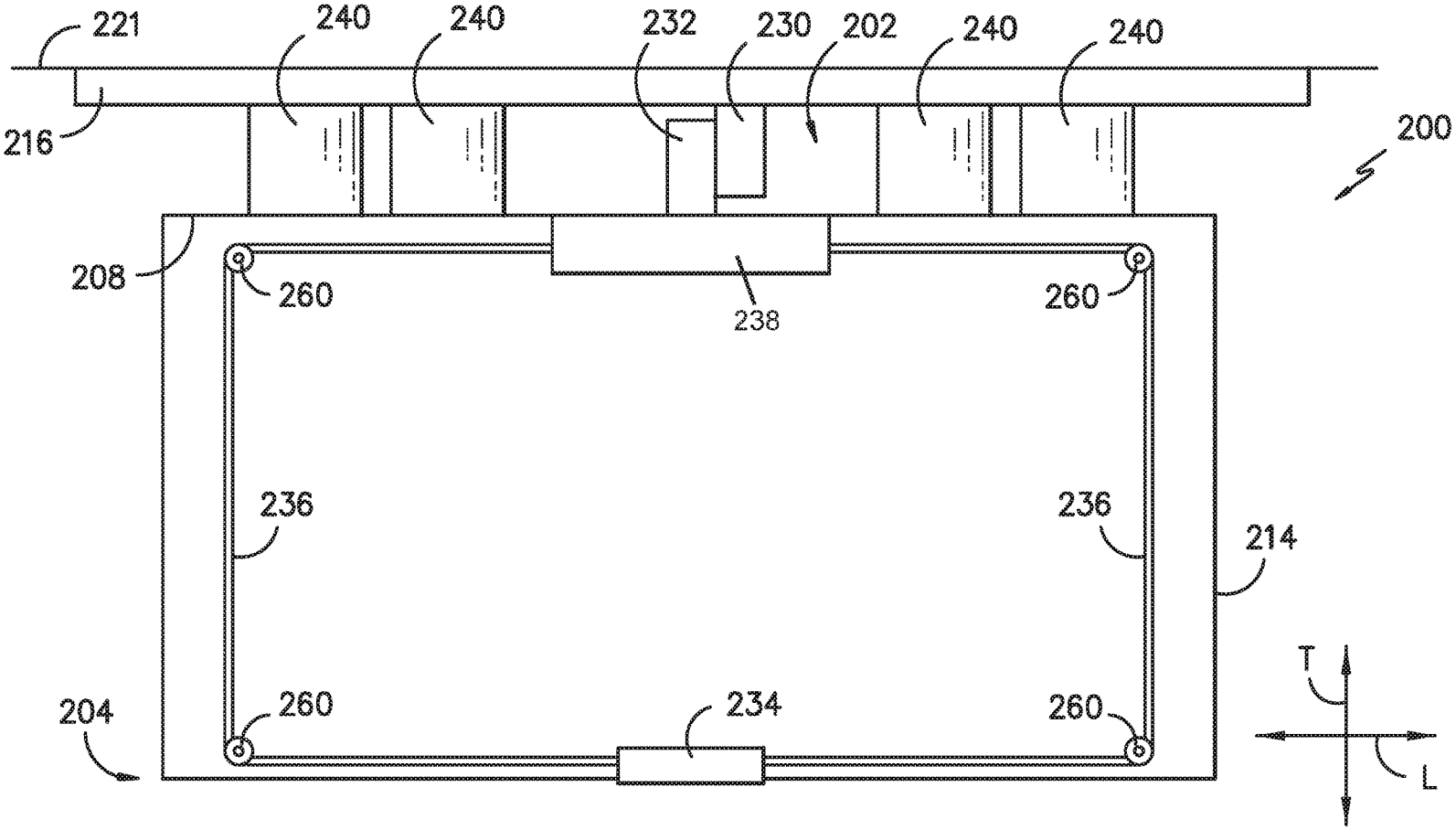
FIG. 5 provides a schematic view of certain components of the exemplary adjustable shelf assembly of FIG. 3.

FIG. 3 provides a perspective view of an adjustable shelf assembly 200 according to an exemplary embodiment of the present subject matter. FIG. 4 provides an exploded view of adjustable shelf assembly 200, and FIG. 5 provides a schematic view of certain components of adjustable shelf assembly 200. Adjustable shelf assembly 200 may be used in or with any suitable refrigerator appliance. For example, adjustable shelf assembly 200 may be used in refrigerator appliance 100 as one of shelves 170. Thus, adjustable shelf assembly 200 is described in greater detail below in the context of refrigerator appliance 100.

Adjustable shelf assembly 200 may be positioned within fresh food chamber 122. In particular, adjustable shelf assembly 200 is mounted to a portion of liner 121, e.g., at a back wall of liner 121. When mounted within refrigerator appliance 100, adjustable shelf assembly 200 may be raised or lowered without being removed from fresh food chamber 122 and/or while items are positioned on the adjustable shelf assembly 200.

Adjustable shelf assembly 200 includes a drive assembly 202 and a shelf frame or support assembly 204. Drive assembly 202 defines a movement axis A along which support assembly 204 may move. Specifically, drive assembly 202 may motivate or at least partially control movement of support assembly 204 along movement axis A, e.g., relative to liner 121. As will be described in detail below, drive assembly 202 may alternately translate support assembly 204 in an upward direction and a downward direction along movement axis A. Generally, upward direction may extend above support assembly 204 while downward direction extends below support assembly 204. When installed within refrigerator appliance 100, movement axis A may be parallel to the vertical direction V. Thus, drive assembly 202 may adjust the height of support assembly 204 within fresh food chamber 122 along the vertical direction V.

In some embodiments, support assembly 204 includes a shelving bracket 206 attached to drive assembly 202. Shelving bracket 206 may include a brace 208 that extends, e.g., perpendicular to movement axis A. When installed within refrigerator appliance 100, brace 208 may generally extend in the lateral direction L between two end portions 210. One or more struts 212 may extend from brace 208, e.g., away from liner 121 and/or toward the cabinet opening selectively covered by doors 128 (see FIG. 2). As an example, a strut 212 may extend from brace 208 in the transverse direction T. In some such embodiments, a discrete strut 212 extends in the transverse direction T from each end portion 210 of brace 208.

In example embodiments, support assembly 204 includes a shelf or storage surface 214 attached to shelving bracket 206. When installed within refrigerator appliance 100, storage surface 214 is generally supported by shelving bracket 206. For instance, storage surface 214 may rest on top of shelving bracket 206 to move therewith, e.g., relative to movement axis A. Optionally, storage surface 214 may be fixed to shelving bracket 206 via one or more suitable adhesives, mechanical fasteners, or other attachment members. In example embodiments, storage surface 214 is a planar surface that extends orthogonal to movement axis A. In turn, storage surface 214 may include a flat, rectangular plate formed from a suitable rigid material, such as tempered glass, plastic, or metal. As a particular example, storage surface 214 may include a flat, rectangular plate glass plate encased by a plastic frame that extends around edges of the glass plate.

As shown in FIGS. 3 and 4, a rear bracket or mounting plate 216 is provided in some embodiments. Support assembly 204, e.g., struts 212, may be slidably connected to mounting plate 216. For example, struts 212 may be slidably connected to mounting plate 216 such that struts 212 are movable along the vertical direction V relative to mounting plate 216 but motion of struts 212 along the lateral and transverse directions L, T relative to mounting plate 216 is constrained by the sliding connection between struts 212 and mounting plate 216. Thus, the sliding connection between struts 212 and mounting plate 216 may provide a single degree of freedom, e.g., along the vertical direction V, for relative motion between struts 212 and mounting plate 216.

Mounting plate 216 may be removably or selectively attached to cabinet 120, e.g., at liner 121. For instance, a track or retainer bar 218 (FIG. 2), e.g., a pair of retainer bars 218, may be fixed to liner 121. Retainer bar 218 may define one or more predetermined height indexes 220 to which mounting plate 216 mount. In some such embodiments, mounting plate 216 includes one or more index mounts 222, which selectively secure mounting plate 216 to a predetermined height index 220. As an example, predetermined height index 220 may be a receiving slot while index mount 222 is an n-shaped hook that may be selectively supported within the receiving slot. It is noted that although the height index-index mount pairs are shown, suitable alternative configurations may be provided within the scope of the present disclosure (e.g., wherein each height index 220 is a u-shaped hook and index mount 222 is a receiving slot).

In example embodiments, mounting plate 216 is generally configured to hold or restrain at least a portion of drive assembly 202. Optionally, mounting plate 216 may include a pair of vertically-spaced tabs 224, 226 that are receivable within height indexes 220. An upper tab 224 may extend from mounting plate 216 at a top portion of mounting plate 216, e.g., in the transverse direction T away from liner 121. A lower tab 226 may extend from mounting plate 216 at a bottom portion of mounting plate 216, e.g., in the transverse direction T away from liner 121. As shown, upper tab 224 and lower tab 226 may be vertically aligned, e.g., such that tabs 224, 226 are in direct parallel alignment relative to the vertical direction V.

As may be seen in FIGS. 3 through 5, drive assembly 202 includes a rack 230, a pinion gear 232, an actuator 234 and a line 236. Rack 230, pinion gear 232, actuator 234 and line 236 cooperate to allow a user to move support assembly 204 along the vertical direction V within fresh food chamber 122. Rack 230 is positioned on mounting plate 216. For example, rack 230 may be fixed to mounting plate 216 with fasteners, adhesive, etc. As another example, rack 230 may be integrally formed on mounting plate 216, e.g., such that mounting plate 216 and rack 230 are single, seamless piece of material, such as molded plastic.

Pinion gear 232 is meshed with rack 230. Thus, teeth of rack 230 may be meshed within teeth of pinion gear 232. Pinion gear 232 is also mounted to shelving bracket 206, e.g., brace 208. In particular, pinion gear 232 may be mounted to brace 208 such that pinion gear 232 is rotatable on brace 208. For example, pinion gear 232 may be rotatable about an axle or shaft 237 on brace 208 that extends along the transverse direction T such that pinion gear 232 is rotatable on the shaft 237 about an axis that is parallel to the transverse direction T. With rack 230 positioned on mounting plate 216 and pinion gear 232 rotatably mounted to brace 208, the meshing connection between rack 230 and pinion gear 232 assists with moving support assembly 204 along movement axis A. In particular, pinion gear 232 may move along the vertical direction V on rack 230 during motion of support assembly 204 along movement axis A, and the meshing connection between rack 230 and pinion gear 232 may assist with holding support assembly 204 at a selected vertical height, as discussed in greater detail below.

Actuator 234 is connected to pinion gear 232 such that a user may utilize actuator 234 to manually rotate pinion gear 232 on rack 230 and adjust the position of support assembly 204 along the vertical direction V. Actuator 234 may be a knob, handle, etc. and may be positioned on support assembly 204. For example, actuator 234 may be positioned on support assembly 204 opposite pinion gear 232 along the transverse direction T. Thus, e.g., actuator 234 may be positioned at a front portion of support assembly 204 adjacent the cabinet opening selectively covered by doors 128, and pinion gear 232 may be positioned at a rear portion of support assembly 204 adjacent liner 121 and mounting plate 216. Line 236 connects or couples actuator 234 to pinion gear 232. Thus, motion of actuator 234 may rotate pinion gear 232 such that pinion gear 232 moves along the vertical direction V on rack 230.

As shown in FIGS. 3 and 4, actuator 234 may be positioned on a front panel 250 of support assembly 204. Front panel 250 may extend between and connect distal end portions of struts 212, e.g., along the lateral direction L. Front panel 250 may define a slot 252 that extends along the lateral direction L, and actuator 234 may be positioned within slot 252. In particular, actuator 234 may be slidable along the lateral direction L within slot 252, and a width of slot 252 along the lateral direction L may be about (e.g., no less than eighty percent of) equal to the width of front panel 250 along the lateral direction L. When a user manually slides actuator 234 within slot 252 along the lateral direction L, line 236 transfers the linear translation of actuator 234 to pinion gear 232 in order to rotate pinion gear 232. For example, a drive wheel 238 is connected or fixed to pinion gear 232. Line 236 is wound about or otherwise mounted to drive wheel 238. As actuator 234 slides within the slot 252 along the lateral direction L, line 236 rotates drive wheel 238 that in turn rotates pinion gear 232. Each end of line 236 may be mounted to drive wheel 238 in certain exemplary embodiments. Drive wheel 238 may have a diameter that is greater than a diameter of pinion gear 232. For example, the diameter of drive wheel 238 may be no less than twice the diameter of pinion gear 232. Such sizing of drive wheel 238 relative to pinion gear 232 may facilitate rotation of pinion gear 232 via actuator 234.

Adjustable shelf assembly 200 also includes at least one biasing element 240. Biasing element 240 is connected to mounting plate 216 and support assembly 204, e.g., brace 208. Biasing element 240 is configured to urge support assembly 204 upwardly along the vertical direction V, e.g., relative to mounting plate 216, and thereby assist with vertical movement of support assembly 204. For example, biasing element 240 may include a plurality of preloaded springs, e.g., two, three, four or more preloaded springs. The preloaded springs may be helical coil springs, gas struts, etc. As a particular example and as shown in FIG. 4, the preloaded springs may each include a casing 242 and a power spring 244. Power springs 244 are mounted within casing 242. Casing 242 may be mounted to one of mounting plate 216 and brace 208, and an end of power spring 244 may be mounted to the other of mounting plate 216 and brace 208. Power springs 244 may urge support assembly 204 upwardly along the vertical direction V relative to mounting plate 216.

Biasing element 240 assist with preloading support assembly 204 for motion along the vertical direction V. For example, the force applied by biasing element 240 may be selected to counteract the weight of food items on support assembly 204 and allow translation of support assembly 204 in an upward direction and a downward direction along movement axis A despite the weight of food items on support assembly 204. As an example, biasing element 240 may be configured to apply no less than ten pounds upwardly along the vertical direction V to support assembly 204.

Adjustable shelf assembly 200 may also include a plurality of pivots 260 for guiding line 236. For example, at least four pivots 260 may be mounted to support assembly 204. In particular, when support assembly 204 is rectangular, a respective pivot 260 may be positioned at each corner of support assembly 204. Line 236 is positioned on pivots 260, and line 236 may slide against pivots 260 during motion of actuator 234. Pivots 260 may be pulleys, rollers, cylindrical posts, etc.

As discussed above, drive assembly 202 may alternately translate support assembly 204 in the upward direction and the downward direction along movement axis A. Operation of drive assembly 202 to translate support assembly 204 along the vertical direction V is discussed in greater detail below in the context of FIG. 5. As will be understood, tall food items may be stored within fresh food chamber 122 below adjustable shelf assembly 200, or tall food items may be stored on adjustable shelf assembly 200 in fresh food chamber 122. To fit the tall food items below or on top of adjustable shelf assembly 200, a user may translate support assembly 204 upward or downward along the movement axis A to provide suitable space for the tall food items.

A user may control adjustable shelf assembly 200 by grasping actuator 234 moving actuator 234 along the lateral direction L. Line 236 is connected to actuator 234 such that line 236 at actuator 234 also translates within line 236. Line 236 is also connected to pinion gear 232, e.g., by being wound about drive wheel 238, such that line 236 rotates pinion gear 232 when line 236 translates with actuator 234. For example, the user may move actuator 234 one way along the lateral direction L to rotate pinion gear 232 one of a clockwise and a counterclockwise direction. Conversely, the user may move actuator 234 the opposite way along the lateral direction L to rotate pinion gear 232 the other of the clockwise and counterclockwise direction. Thus, by selecting which way to move actuator 234 along the lateral direction L within slot 252, the user may control a rotation direction of pinion gear 232. It will be understood that the user may position actuator 234 at any location along the lateral direction L within slot 252, and each location of the actuator 234 along the lateral direction L within slot 252 corresponds to a respective height of storage surface 214 within fresh food chamber 122. Thus, support assembly 204 may translate to any location along the vertical direction V between a maximum and a minimum location and may not be limited to discrete height settings.

Pinion gear 232 is meshed with rack 230, and rack 230 is oriented along the vertical direction V. Thus, pinion gear 232 may move up or down along the vertical direction V on rack 230 when the user moves actuator 234 along the lateral direction L. Pinion gear 232 is mounted to support assembly 204 such that support assembly 204 moves in the upward direction along movement axis A when pinion gear 232 rotates upwardly along the vertical direction V on rack 230 and such that support assembly 204 moves in the downward direction along movement axis A when pinion gear 232 rotates downwardly along the vertical direction V on rack 230. In such a manner, a user may translate actuator 234 to rotate pinion gear 232 and translate support assembly 204 along the vertical direction V.

Adjustable shelf assembly 200 may provide flexible storage within refrigerator appliance 100. For example, storage surface 214 may be movable by no less than two inches and no more than four inches along the vertical direction V, e.g., relative to mounting plate 216, with drive assembly 202. Thus, tall food items may be more easily stored within refrigerator appliance 100 below or on top of adjustable shelf assembly 200 without having to reposition adjustable shelf assembly 200 on retainer bars 218. In addition, drive assembly 202 and biasing element 240 may be configured such that a user may have to apply no more than seven and a half pounds to actuator 234 in order to slide actuator 234 and translate support assembly 204 along the vertical direction V. Thus, drive assembly 202 may more easily translate support assembly 204 along the vertical direction V relative to known adjustable shelves and may allow for movement of support assembly 204 along the vertical direction V without unloading food items from support assembly 204. In addition, drive assembly 202 may require no external lubrication maintenance. Drive assembly 202 may also include a motor (e.g., coupled to line 236 or drive wheel 238) that may translate support assembly 204 along the vertical direction V. Thus, adjustable shelf assembly 200 may be manually and/or automatically adjustable.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A refrigerator appliance, comprising:

a cabinet defining a chilled chamber;

an adjustable shelf assembly positioned within the chilled chamber of the cabinet, the adjustable shelf assembly comprising a rear bracket mountable to the cabinet;

a rack positioned on the rear bracket;

a pinion gear meshed with the rack;

a drive wheel fixed to the pinion gear such that the drive wheel rotates with the pinion gear;

a shelf frame slidably mounted to the rear bracket, the pinion gear rotatably mounted to the shelf frame;

an actuator positioned on the shelf frame;

a line coupling the actuator to the pinion gear such that the pinion gear is rotatable with the actuator via the line, each end of the line wound onto the drive wheel such that the drive wheel is rotatable by the line, wherein the shelf frame is configured to move along a vertical direction relative to the rear bracket when the pinion gear is rotated by the actuator via the line.

2. The refrigerator appliance of claim 1, wherein the adjustable shelf assembly further comprises a biasing element connected to the rear bracket and the shelf frame, the biasing element urging the shelf frame upwardly along the vertical direction relative to the rear bracket.

3. The refrigerator appliance of claim 2, wherein the biasing element comprising a plurality of preloaded springs.

4. The refrigerator appliance of claim 3, wherein each preloaded spring of the plurality of preloaded springs comprises a power spring.

5. The refrigerator appliance of claim 1, wherein the actuator is a knob mounted to a front panel of the shelf frame, the knob movable along a lateral direction within a slot defined by the front panel, the line connected to the knob.

6. The refrigerator appliance of claim 5, wherein the adjustable shelf assembly further comprises four pivots, the shelf frame being a rectangular shelf frame with each pivot of the four pivots mounted to the rectangular shelf frame at a respective corner of the rectangular shelf frame, the line positioned on the four pivots.

7. The refrigerator appliance of claim 1, wherein the cabinet comprises a pair of tracks positioned within the chilled chamber of the cabinet and spaced apart along a lateral direction, each track of the pair of tracks defining a plurality of holes that are spaced along the vertical direction, the rear bracket comprising a pair of hooks, each hook of the pair of hooks received within a respective one of the plurality of holes of the pair of tracks when the rear bracket is mounted to the cabinet.

8. The refrigerator appliance of claim 1, wherein the shelf frame is movable no less than two inches and no more than four inches along the vertical direction relative to the rear bracket when the pinion gear is rotated by the actuator via the line.

9. The refrigerator appliance of claim 1, wherein the rack is positioned at a middle portion of the rear bracket.

10. The refrigerator appliance of claim 1, wherein a diameter of the drive wheel is no less than twice a diameter of the pinion gear.

11. An adjustable shelf assembly for a refrigerator appliance, comprising:

a rear bracket;

a rack positioned on the rear bracket;

a pinion gear meshed with the rack;

a drive wheel fixed to the pinion gear such that the drive wheel rotates with the pinion gear;

a shelf frame slidably mounted to the rear bracket, the pinion gear rotatably mounted to the shelf frame;

an actuator positioned on the shelf frame;

a line coupling the actuator to the pinion gear such that the pinion gear is rotatable with the actuator via the line, each end of the line wound onto the drive wheel such that the drive wheel is rotatable by the line, wherein the shelf frame is configured to move along a vertical direction relative to the rear bracket when the pinion gear is rotated by the actuator via the line.

12. The adjustable shelf assembly of claim 11, wherein the adjustable shelf assembly further comprises a biasing element connected to the rear bracket and the shelf frame, the biasing element urging the shelf frame upwardly along the vertical direction relative to the rear bracket.

13. The adjustable shelf assembly of claim 12, wherein the biasing element comprising a plurality of preloaded springs.

14. The adjustable shelf assembly of claim 13, wherein each preloaded spring of the plurality of preloaded springs comprises power spring.

15. The adjustable shelf assembly of claim 11, wherein the actuator is a knob mounted to a front panel of the shelf frame, the knob movable along a lateral direction within a slot defined by the front panel, the line connected to the knob.

16. The adjustable shelf assembly of claim 15, wherein the adjustable shelf assembly further comprises four pivots, the shelf frame being a rectangular shelf frame with each pivot of the four pivots mounted to the rectangular shelf frame at a respective corner of the rectangular shelf frame, the line positioned on the four pivots.

17. The adjustable shelf assembly of claim 11, further comprising a pair of tracks spaced apart along a lateral direction, each track of the pair of tracks defining a plurality of holes that are spaced along the vertical direction, the rear bracket comprising a pair of hooks, each hook of the pair of hooks received within a respective one of the plurality of holes of the pair of tracks.

18. The adjustable shelf assembly of claim 11, wherein the shelf frame is movable no less than two inches and no more than four inches along the vertical direction relative to the rear bracket when the pinion gear is rotated by the actuator via the line.

* * * * *